US010020101B2

(12) United States Patent
Takajo et al.

(10) Patent No.: US 10,020,101 B2
(45) Date of Patent: Jul. 10, 2018

(54) GRAIN-ORIENTED ELECTRICAL STEEL SHEET AND METHOD FOR PRODUCING SAME

(71) Applicant: JFE STEEL CORPORATION, Tokyo (JP)

(72) Inventors: Shigehiro Takajo, Tokyo (JP); Seiji Okabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 136 days.

(21) Appl. No.: 14/367,654

(22) PCT Filed: Dec. 21, 2012

(86) PCT No.: PCT/JP2012/008202
§ 371 (c)(1),
(2) Date: Jun. 20, 2014

(87) PCT Pub. No.: WO2013/094218
PCT Pub. Date: Jun. 27, 2013

(65) Prior Publication Data

US 2015/0034211 A1 Feb. 5, 2015

(30) Foreign Application Priority Data

Dec. 22, 2011 (JP) ..... 2011-282271

(51) Int. Cl.
*H01F 1/16* (2006.01)
*C21D 8/12* (2006.01)
(Continued)

(52) U.S. Cl.
CPC ..... *H01F 1/16* (2013.01); *C21D 1/34* (2013.01); *C21D 1/38* (2013.01); *C21D 8/12* (2013.01);
(Continued)

(58) Field of Classification Search
CPC ..... H01F 1/16; C21D 8/12
(Continued)

(56) References Cited

U.S. PATENT DOCUMENTS 4,915,749 A 4/1990 Fukuda et al.
5,411,604 A 5/1995 Inokuti
(Continued)

FOREIGN PATENT DOCUMENTS

CN 1216072 5/1999
EP 0897016 2/1999
(Continued)

OTHER PUBLICATIONS

Extended European search report, dated Apr. 7, 2015, in corresponding European Patent Application No. 12860627.4.
(Continued)

*Primary Examiner* — Weiping Zhu
(74) *Attorney, Agent, or Firm* — Young & Thompson

(57) ABSTRACT

Disclosed is a grain-oriented electrical steel sheet exhibiting low hysteresis loss and low coercive force, in which an increase in hysteresis loss due to laser irradiation or electron beam irradiation, which has been a conventional concern, is effectively inhibited. The grain-oriented electrical steel sheet has closure domain regions (X) formed to divide the magnetic domains in a rolling direction, from one end to the other in the width direction of the steel sheet, provided that Expression (1) is satisfied:

$$-(500t-80)\times s+230\leq w\leq-(500t-80)\times s+330 \quad \text{Expression (1),}$$

where t represents a sheet thickness (mm); w represents a smaller one of the widths (μm) of the regions measured on the front and rear surfaces of the steel sheet, respectively, by using a Bitter method; and s represents an average number of the regions present within one crystal grain.

16 Claims, 2 Drawing Sheets

(51) Int. Cl.
*C22C 38/00* (2006.01)
*C21D 1/38* (2006.01)
*C21D 1/34* (2006.01)

(52) U.S. Cl.
CPC ..... *C21D 8/1294* (2013.01); *C22C 38/00* (2013.01); *C21D 8/1244* (2013.01); *C21D 2201/05* (2013.01)

(58) Field of Classification Search
USPC ..... 148/100
See application file for complete search history.

(56) References Cited

U.S. PATENT DOCUMENTS

| | | | | |
|---|---|---|---|---|
| 6,368,424 | B1 | 4/2002 | Sakai et al. | |
| 8,790,471 | B2 | 7/2014 | Sakai et al. | |
| 2001/0032684 | A1 | 10/2001 | Sakai et al. | |
| 2006/0169362 | A1* | 8/2006 | Sakai ..... | C21D 8/1294 148/110 |
| 2013/0118654 | A1 | 5/2013 | Sakai et al. | |
| 2014/0246125 | A1 | 9/2014 | Sakai et al. | |
| 2014/0352849 | A1 | 12/2014 | Suehiro et al. | |

FOREIGN PATENT DOCUMENTS

| | | |
|---|---|---|
| EP | 2799574 | 11/2014 |
| EP | 2813593 | 12/2014 |
| JP | 58-144424 | 8/1983 |
| JP | 63-262421 | 10/1988 |
| JP | 2-8027 | 2/1990 |
| JP | 03-13293 | 2/1991 |
| JP | 03-72026 | 3/1991 |
| JP | 03-72027 | 3/1991 |
| JP | 07-65106 | 7/1995 |
| JP | 2002-012918 | 1/2002 |
| JP | 2002-356750 | 12/2002 |
| JP | 3386727 | 3/2003 |
| JP | 4091749 | 5/2008 |
| JP | 4123679 | 5/2008 |
| JP | 4344264 | 10/2009 |
| JP | 4585101 | 11/2010 |
| JP | 4616623 | 1/2011 |
| JP | 4782248 | 9/2011 |
| WO | WO 2004/083465 | 9/2004 |

OTHER PUBLICATIONS

International Search Report, PCT/JP2012/008202, dated Apr. 2, 2013.

Korean Official Action—10-2014-7016938—dated Apr. 20, 2015.

Chinese Office Action dated Aug. 25, 2015, with English Translation; Application No. 201280063637.4.

Japanese Office Action, dated Nov. 11, 2014, in corresponding Japanese Patent Application No. 2013-550134.

U.S. Patent and Trademark Office Action dated Nov. 15, 2016 with regard to U.S. Appl. No. 14/367,273 which rejects the same for non-statutory double-patenting over U.S. Appl. No. 14/367,654.

U.S. Office Action (Advisory Action) dated Mar. 10, 2017 in U.S. Appl. No. 14/367,273.

* cited by examiner

GRAIN-ORIENTED ELECTRICAL STEEL SHEET AND METHOD FOR PRODUCING SAME

TECHNICAL FIELD

The present invention relates to a grain-oriented electrical steel sheet suitable for use as an iron core of a transformer or the like and exhibiting low hysteresis loss and low coercive force, and to a method for producing the same.

BACKGROUND ART

In recent years, in the context of efficient use of energy, there have been demands mainly from transformer manufacturers and the like for an electrical steel sheet with high flux density, low iron loss, and low noise.

The flux density can be improved by making crystal orientations of the electrical steel sheet in accord with the Goss orientation. JP 4123679 B2 (PTL 1), for example, discloses a method for producing a grain-oriented electrical steel sheet having a flux density $B_8$ exceeding 1.97 T.

On the other hand, iron loss properties may be improved by increased purity of the material, high orientation, reduced sheet thickness, addition of Si and Al, and magnetic domain refining (for example, see "*Recent progress in soft magnetic steels,*" 155$^{th}$/156$^{th}$ *Nishiyama Memorial Technical Seminar, The Iron and Steel Institute of Japan, Feb.* 1, 1995 (NPL 1)). Additionally, JP 3386727 B2 (PTL 2) discloses a method for producing a grain-oriented steel sheet having a reduced coercive force by adjusting an annealing separator and exhibiting advantageous iron loss properties.

In addition, noise may be reduced by reducing the area of regions, called "closure domains," with magnetic moment being oriented perpendicular to the external magnetic field direction. Many studies have reported on methods for reducing such closure domains, such as disclosed in JP 4585101 B2 (PTL 3), with particular consideration given to, among other things, the effectiveness of "according the <100> orientation of crystal grains with a rolling direction of the steel sheet" for improving flux density $B_8$ and reducing hysteresis loss.

On the other hand, however, it is known that when the <100> orientation of crystal grains is in accord with the rolling direction, the magnetostatic energy decreases, and therefore the magnetic domain width widens, causing an increase in eddy current loss.

Therefore, as a method for reducing eddy current loss, some techniques have been used for refining magnetic domains by improving film tension and applying thermal strain.

Methods for improving film tension, such as disclosed in JP H02-8027 B2 (PTL 4), are effective for eliminating closure domains and thus advantageous for reducing noise. There are limits, however, on the amount of tension that can be applied to the steel sheet.

On the other hand, magnetic domain refining by applying thermal strain is performed by means of laser irradiation, electron beam irradiation and the like, and has a significant effect on reducing eddy current loss.

For example, JP H07-65106 B2 (PTL 5) discloses a method for producing an electrical steel sheet having a reduced iron loss $W_{17/50}$ of below 0.8 W/kg by using electron beam irradiation. It can be seen from PTL 5 that the electron beam irradiation is extremely useful for reducing iron loss.

In addition, JP H03-13293 B2 (PTL 6) discloses a method for reducing iron loss by applying laser irradiation to the steel sheet.

CITATION LIST

Patent Literature

PTL 1: JP 4123679 B2
PTL 2: JP 3386727 B2
PTL 3: JP 4585101 B2
PTL 4: JP H02-8027 B2
PTL 5: JP H07-65106 B2
PTL 6: JP H03-13293 B2
PTL 7: JP 4091749 B2
PTL 8: JP 4344264 B2

Non-Patent Literature

NPL 1: *"Recent progress in soft magnetic steels,"* 155$^{th}$/156$^{th}$ *Nishiyama Memorial Technical Seminar, The Iron and Steel Institute of Japan, Feb.* 10, 1995

SUMMARY OF INVENTION

Technical Problem

However, irradiation of a laser beam, an electron beam and the like, which may subdivide magnetic domains to reduce eddy current loss, rather increases hysteresis loss.

For example, JP 4091749 B2 (PTL 7) discloses: "When a steel sheet is irradiated with a laser beam, stress and strain are applied to a surface layer thereof due to evaporation reaction force of the coating or rapid heating and rapid cooling. Originating from the strain, closure domains are formed as wide as the strain, in which 180° magnetic domains are subdivided to minimize the magnetostatic energy. As a result, eddy current loss decreases proportional to the width of 180° magnetic domains, leading to a reduction in iron loss. On the other hand, hysteresis loss increases with the application of strain. That is, the reduction of iron loss using a laser beam is achieved by the application of such optimum stress and strain as to minimize the iron loss that is the sum of eddy current loss, which decreases with increasing strain, and hysteresis loss, which increases with increasing strain, as schematically illustrated in FIG. 11. Thus, it is ideal to reduce eddy current loss sufficiently and to minimize an increase in hysteresis loss, and consequently, there is a demand for such a grain-oriented electrical steel sheet that can solve the problem."

In addition, JP 4344264 B2 (PTL 8) states that hardening regions in a steel sheet caused by laser irradiation and the like prevent domain wall displacement and increase hysteresis loss.

It is also believed that such closure domains increase magnetostriction, and consequently, the resulting steel sheet produces increased noise upon excitation when used as the iron core of a transformer.

To solve the aforementioned problems, PTL 8 discloses a technique for further reducing iron loss by adjusting the laser output and the spot diameter ratio to thereby reduce the size of a region, which hardens with laser irradiation, in a direction perpendicular to the laser scanning direction, to 0.6 mm or less, and by suppressing an increase in hysteresis loss caused by the irradiation. Nevertheless, this technique still has a problem in that the minimization of iron loss by irradiating with a laser beam, an electron beam and the like causes a great increase in hysteresis loss and noise, as compared to those before the irradiation.

The present invention has been developed in view of the current situation as described above. An object of the present invention is thus to provide a grain-oriented electrical steel sheet exhibiting low hysteresis loss and low coercive force, in which an increase in hysteresis loss due to laser irradiation or electron beam irradiation, which has been a conventional concern, is effectively inhibited.

Solution to Problem

The inventors of the present invention have made intensive studies to solve the aforementioned problems, and found that both eddy current loss and hysteresis loss may be reduced by improving the magnetic domain refining treatment using a laser beam, an electron beam and the like.

The aforementioned magnetic domain refining treatment serves to produce closure domains in a steel sheet, while eliminating so-called "lancet domains" previously present in the steel sheet before the irradiation. The lancet domain is a region that has a magnetic moment in the sheet thickness direction and is formed for the purpose of reducing the magnetostatic energy to be produced when the crystal orientation (β angle) deviates from the ideal <100> orientation by several degrees.

Although the details of the mechanism of this phenomenon are not known exactly, the present inventors envision two possibilities: the closure domains newly formed by the magnetic domain refining, instead of the lancet domains, stabilized the magnetostatic energy; or lancet domains were eliminated by being destabilized the internal stress formed in the steel sheet during the magnetic domain refining.

The present inventors have made a new finding that the hysteresis loss and the coercive force may be further reduced, as compared to those before the irradiation, by increasing the ratio of closure domains (lancet domains) to be eliminated in the entire closure domains formed by laser irradiation, electron beam irradiation and the like. The present invention has been completed based on this finding.

Specifically, the primary features of the present invention are as described below.

[1] A grain-oriented electrical steel sheet comprising closure domain regions X formed to divide magnetic domains of the steel sheet in a rolling direction, from one end to the other in the width direction of the steel sheet, in a linear or curved manner, and periodically in the rolling direction, provided that Expression (1) is satisfied:

$$-(500t-80)\times s+230 \leq w \leq -(500t-80)\times s+330 \qquad \text{Expression (1)},$$

where t represents a sheet thickness in millimeters; w represents a smaller one of the widths in micrometers of the regions X measured on front and rear surfaces of the steel sheet by using a Bitter method, respectively; and s represents an average number of the regions X present within one crystal grain.

[2] A method for producing the grain-oriented electrical steel sheet according to the aspect [1], the method comprising, in irradiating one surface of the steel sheet with a laser beam or an electron beam, adjusting, depending on an average grain size of the steel sheet, at least any one of a periodic irradiation interval L in the rolling direction, irradiation energy E, and a beam diameter a, so that closure domain regions X are formed to divide magnetic domains of the steel sheet in a rolling direction, from one end to the other in the width direction of the steel sheet, in a linear or curved manner, and periodically in the rolling direction.

Advantageous Effect of Invention

According to the present invention, by applying appropriate closure domains at the time of magnetic domain refining, not only can eddy current loss be reduced, but also hysteresis loss can be reduced, although the reduction of both losses at the same time has conventionally been hard to achieve.

In addition, the grain-oriented electrical steel sheet according to the present invention exhibits low hysteresis loss as well as low coercive force upon excitation at 1.7 T, and thus has the advantage of improving the energy efficiency of the resulting transformer. The present invention can also achieve noise reduction because of a very small amount of closure domains, which are responsible for causing noise. Therefore, the present invention proves extremely useful in industrial terms.

BRIEF DESCRIPTION OF DRAWINGS

The present invention will be further described below with reference to the accompanying drawings, wherein.

DESCRIPTION OF EMBODIMENTS

The present invention will now be described in detail below.

The present invention is applied to a grain oriented electrical steel sheet. The grain oriented electrical steel sheet may be coated with an insulating coating and the like, or have a coating partially coming off from its surface, or even no coating thereon.

Figure 1:
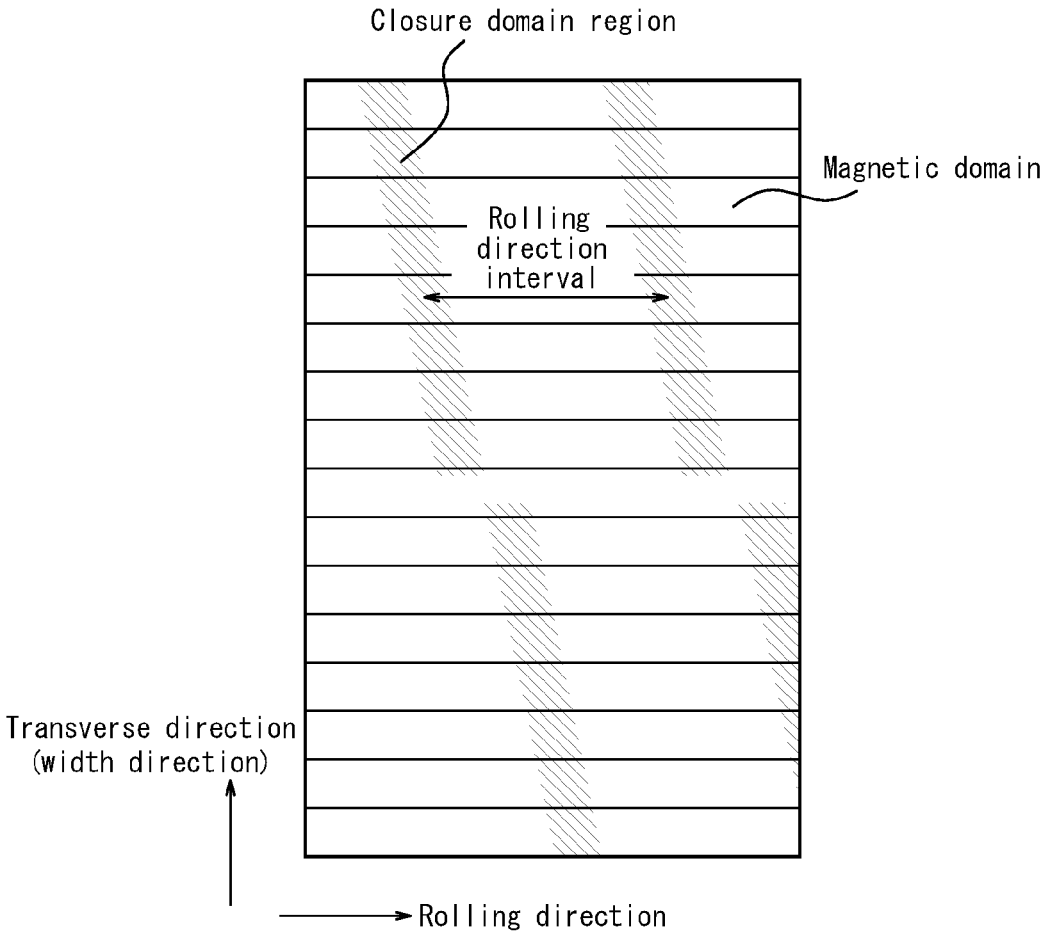
FIG. 1 illustrates the formation of a closure domain region X.

In addition, the electrical steel sheet according to the present invention has closure domain regions X formed to divide magnetic domains of the steel sheet, from one end to the other in the width direction of the steel sheet, in a linear or curved manner, and periodically in a rolling direction. Here, the irradiation in the width direction may not necessarily be performed in a continuous and linear manner, but may also be performed in a discontinuous manner, such as once every several hundred millimeters. That is, for example, the irradiation may be repeated at intervals with appropriate shift as shown in FIG. 1. Note that crystal grain boundaries are not included in the aforementioned closure domain regions formed to divide magnetic domains in the rolling direction.

Considering the amount of change in iron loss before and after the aforementioned closure domain regions X are applied, it is generally believed that a reduction in eddy current loss corresponding to magnetic domain refining and an increase in hysteresis loss with increasing closure domains will be more pronounced with a larger width w of the regions X and with a larger average number s of regions X present within one crystal grain.

The present inventors, however, have found that hysteresis loss decreases when the aforementioned s and w as well as the sheet thickness t satisfy a certain relationship.

Here, an average number s of regions X present within one crystal grain was defined by $\Sigma$ (i=1, N) $S_i \times n_i$, where $S_i$ is the measured area ratio of a crystal grain i present within a sample for magnetometry (where i=1 to N; N is the total number of crystal grains) and $n_i$ is the measured number of regions X present within that crystal grain. While the coating may be detached using hydrochloric acid, nitric acid and the like until crystal grains can be detected visually if they cannot be observed easily through the coating, excessive detachment causes elution of the steel substrate and brings about a change in the width of regions X from that with the coating. Consequently, the width of the regions X is preferably measured together with the coating in advance. In addition, the width of the regions X may differ whether measured on the front or rear surface of the steel sheet, and thus was defined by a smaller one, indicated by w. When regions X are observed only on one surface, however, w represents the width on that surface. When w considerably fluctuates in the width direction, the width of regions X is determined by averaging the results obtained in the width direction.

Note that the width of closure domain regions X is measured by using a Bitter method.

Here, the Bitter method is used to observe domain walls and the like by using magnetic colloids, which tend to be attracted to areas where the magnetization state changes greatly.

The present inventors have experimentally determined, through optimization of the aforementioned w and s, the condition under which magnetic domains can be subdivided to reduce eddy current loss, and furthermore, to reduce hysteresis loss as compared to that prior to the irradiation.

Figure 2:
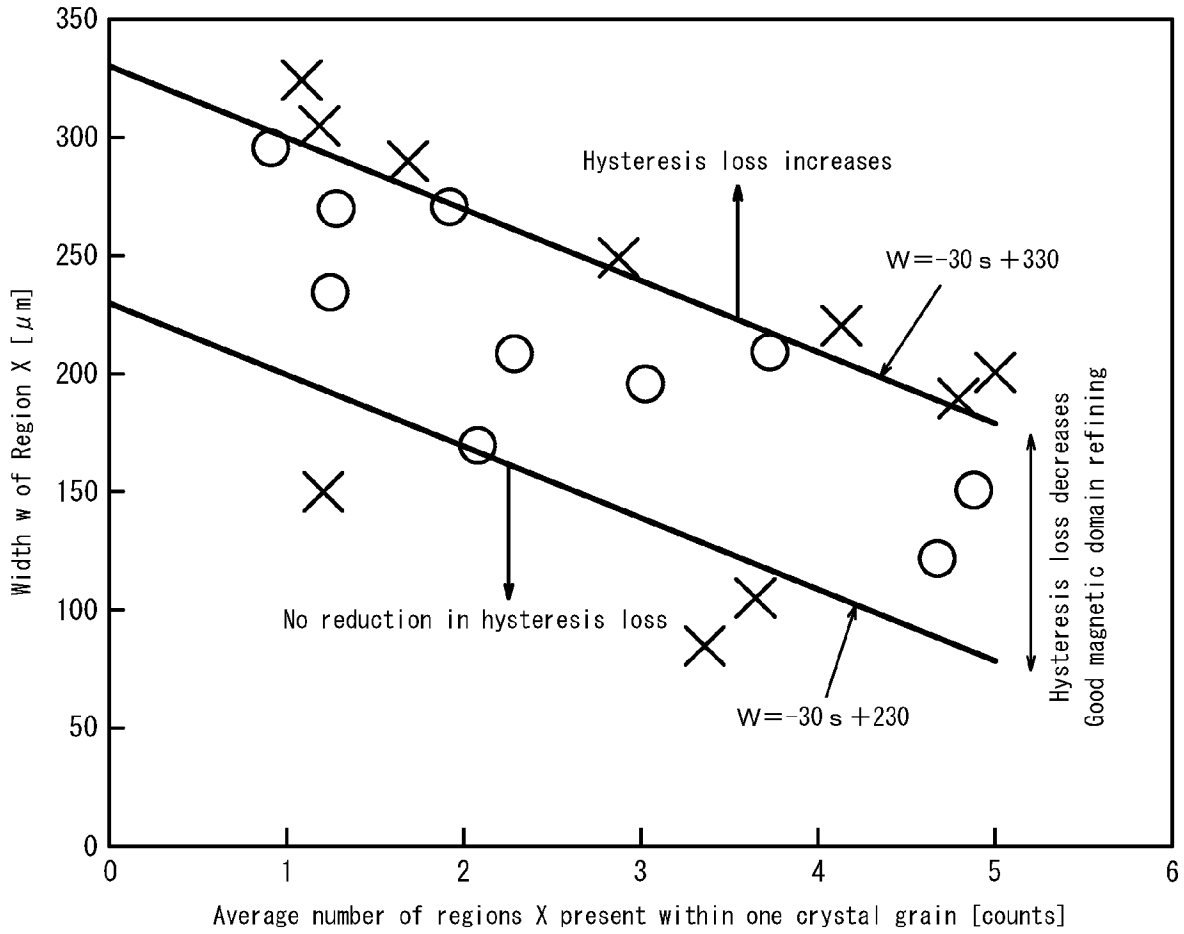
FIG. 2 is a graph showing how the width w of closure domain regions X and an average number s of closure domain regions X present within one crystal grain affect magnetic domain refining and hysteresis loss.

FIG. 2 shows the results of investigating how w and s, in the case of electron beam irradiation, affect magnetic domain refining and hysteresis loss.

As shown in the figure, it was revealed that the condition under which magnetic domains are subdivided to reduce hysteresis loss as compared to that prior to the irradiation is defined by:

$$-(500t-80)\times s+230 \leq w \leq -(500t-80)\times s+330 \qquad \text{Expression (1)}$$

Note that if $w<-(500t-80)\times s+230$, then the domains that are originally present in the steel sheet cannot be reduced by irradiation and a hysteresis loss reduction effect is insufficient; or if $-(500t-80)\times s+330<w$, then closure domains increase by irradiation too much to realize a reduction in hysteresis loss.

For example, assuming that the aforementioned sheet thickness t is 0.22 mm, the condition under which hysteresis loss becomes lower than that prior to the irradiation is given by:

$$-30\times s+230 \leq w \leq -30\times s+330 \qquad \text{Expression (2)}$$

Note that if $w<-30\times s+230$, then the closure domains that are originally present in the steel sheet cannot be reduced by irradiation and a hysteresis loss reduction effect is insufficient; or if $-30\times s+330<w$, then closure domains increase by irradiation too much to realize a reduction in hysteresis loss.

In addition, it was found that the range of w within which hysteresis loss can be reduced becomes narrower with increasing sheet thickness t. Presumably, this is because a small sheet thickness t provides small domain wall energy, which allows magnetic domain refining to readily occur upon irradiation with a laser beam, an electron beam and the like and magnetostatic energy to decrease, with the result that lancet domains, which would otherwise be formed for the purpose of reducing magnetostatic energy, are no longer required and thus are removed. Therefore, from the perspective of maximizing the effect of reducing hysteresis loss, the sheet thickness t is preferably 0.27 mm or less.

The present inventors have also found that there is a tendency that as s increases, hysteresis loss is increased excessively. Although the details of the mechanism of this phenomenon are not known exactly, it can be presumed that this phenomenon arose in response to the fact that since almost all the closure domains originally present within a grain will be removed even when s is still small, larger s provides a larger heat-affected zone and ends up with larger hysteresis loss, despite being less effective for reducing closure domains. On the other hand, if s is too small, the resulting hysteresis loss reducing effect is insufficient.

Therefore, an average number s of regions X present within one crystal grain is preferably about 0.3 to about 10.

In addition, the width w of closure domain regions X is preferably about 30 μm to about 320 μm.

The present inventors have further found that a grain-oriented electrical steel sheet exhibiting low hysteresis loss and low coercive force as described above may be produced by, in irradiating one surface of the steel sheet with a laser beam or an electron beam, adjusting, depending on an average grain size of the steel sheet, at least any one of a periodic irradiation interval L in the rolling direction, irradiation energy E, and a beam diameter a, so that the aforementioned closure domain regions X are formed.

For example, assuming an average grain size D of the steel sheet in the rolling direction is defined by $D=\Sigma\ (i=1, N)\ S_i\times d_i$, where $d_i$ is the maximum length in the rolling direction of the $i^{th}$ crystal grain, then, with a sufficiently large number of crystal grains, the following holds:

$$s=[D/L] \text{ or } [D/L+1],$$

where [x] refers to a maximum integer not exceeding x.

It follows that the width w of regions X and the irradiation interval L may be adjusted so that the s satisfies Expression (1). The width w of regions X, which is in high correlation with the irradiation energy E and the beam diameter a, increases with larger E and, for irradiation at the same energy, increases with smaller a. Thus, it is possible to control w by adjusting E and a, provided that the relations among w and E, a are derived beforehand through test irradiation.

In addition, considering a measurement variation of about 0.002 W/kg of hysteresis loss, the amount of change by which the hysteresis loss is determined as being reduced by irradiation upon detection was set as: (pre-irradiation hysteresis loss)−(post-irradiation hysteresis loss)≥0.003 W/kg.

Regions X may be applied by, for example, scribing with a tool such as a ballpoint pen, a knife and the like, heat/light/particle beam irradiation, and so on. When regions X are applied by scribing with a ballpoint pen, a knife or the like, however, more strain is applied and the hysteresis loss tends to increase. Thus, heat/light/particle beam irradiation, such as laser irradiation, electron beam irradiation, and plasma flame irradiation, is preferred.

EXAMPLES

Example 1

The material used in this experiment were grain-oriented electrical steel sheets, each having a measured sheet thickness of 0.22 mm and a flux density $B_8$ in the rolling direction of 1.85 T to 1.95 T, and having a dual-layer coating on its surfaces, including a vitreous coating, which is mainly composed of $Mg_2SiO_4$, and a coating (a phosphate-based coating), which is formed by baking an inorganic treatment solution thereon.

Electron beam irradiation and laser irradiation were used to apply closure domain regions X. In each irradiation run, an electron beam and a laser beam were scanned linearly over the entire sheet width so that the electron beam irradiation portions and the laser irradiation portions extend across the steel sheet in the transverse direction (a direction orthogonal to the rolling direction) of the steel sheet.

For electron beam irradiation, the irradiation was repeated along the scanning line so that a long irradiation time ($s_1$) and a short irradiation time ($s_2$) alternate, and a distance interval (dot pitch) between repetitions of the irradiation was set to be 0.05 mm to 0.6 mm. In addition, since $s_2$ is generally small enough to be ignored as compared with $s_1$, the inverse of $s_1$ can be considered as the irradiation frequency, which was set to be 10 kHz to 250 kHz. Further, the scanning rate was set to be 4 m/s to 80 m/s and the interval between repetitions of the irradiation in the rolling direction was set to 3 mm to 50 mm. Note that in electron beam irradiation, the shortest distance from the center of a converging coil to the irradiated material was set to 700 mm and the pressure in the working chamber was set to be 2 Pa or less.

On the other hand, for laser irradiation, the irradiation was carried out by continuous irradiation (dot pitch: 0) or intermittent pulse irradiation (pulse interval: 0.3 mm), in which the scanning rate was set to be 10 m/s and the interval between repetitions of the irradiation in the rolling direction was set to be 3 mm to 50 mm. As the laser, a fiber laser was used for continuous irradiation and a YAG laser was used for pulse irradiation; in either case the wavelength was set to be 1064 nm.

After the application of closure domain regions X according to the aforementioned method, the width of the regions X was measured from the front and rear surfaces of each steel sheet by a Bitter method using a magnetic viewer (MV-95, manufactured by Sigma Hi-Chemical Inc.) to determine w. Then, the iron loss was measured. Subsequently, the coating was detached by using an aqueous solution, which was obtained by mixing 500 mL of a 47% hydrogen fluoride solution with an aqueous solution obtained by diluting 5 L of a 35% hydrochloric acid solution with 20 L of water, and an aqueous solution, which was obtained by diluting 500 mL of a 67.5% sulfuric acid solution with 10 L of water.

The regions X present within each crystal grain in each sample from which the coating was detached were observed and counted using the magnetic viewer to determine s.

Table 1 shows the width w of closure domain regions X and the number s of closure domain regions X.

Table 1 also shows the results of measuring the pre-irradiation hysteresis loss $Wh_{17/50}$, the post-irradiation improvement in hysteresis loss $\Delta Wh_{17/50}$ (pre-irradiation minus post-irradiation score), and the post-irradiation improvement in eddy current loss $\Delta We_{17/50}$ (pre-irradiation minus post-irradiation score).

Table 1 further shows the results of measuring the pre-irradiation coercive force Hc and the post-irradiation improvement in coercive force ΔHc (pre-irradiation minus post-irradiation score).

Note that the tension applied by coating is labeled as A, B, or C in Table 1, where A denotes a tension in the range of over 10 MPa to 15 MPa or less, B denotes a tension in the range of over 5 MPa to 10 MPa or less, and C denotes a tension of 5 MPa or less.

TABLE 1

| No. | Region X Applied by | Coating Tension* | w (μm) | s (conunts) | Conditional Expression Applicability | Hysteresis Loss $Wh_{17/50}$ (W/kg) | Improvement in Hysteresis Loss $\Delta Wh_{17/50}$ (W/kg) | Improvement in Eddy Current Loss $\Delta We_{17/50}$ (W/kg) | Coercive Force Hc (A/m) | Improvement in Coercive force ΔHc (A/m) | Remarks |
|---|---|---|---|---|---|---|---|---|---|---|---|
| 1 | Electron Beam | A | 325 | 1.1 | Not Applicable | 0.306 | −0.003 | 0.065 | 5.74 | 0.22 | Comparative Example |
| 2 | Electron Beam | A | 305 | 1.2 | Not Applicable | 0.300 | −0.002 | 0.060 | 5.54 | 0.31 | Comparative Example |
| 3 | Electron Beam | A | 295 | 1.0 | Applicable | 0.283 | 0.003 | 0.064 | 5.48 | 0.37 | Inventive Example |
| 4 | Electron Beam | B | 270 | 1.3 | Applicable | 0.261 | 0.004 | 0.076 | 5.58 | 0.26 | Inventive Example |
| 5 | Electron Beam | A | 235 | 1.3 | Applicable | 0.286 | 0.008 | 0.071 | 5.78 | 0.38 | Inventive Example |
| 6 | Electron Beam | A | 290 | 1.7 | Not Applicable | 0.294 | −0.003 | 0.072 | 5.73 | 0.21 | Comparative Example |
| 7 | Electron Beam | C | 270 | 2.0 | Applicable | 0.284 | 0.011 | 0.078 | 5.59 | 0.52 | Inventive Example |
| 8 | Electron Beam | A | 210 | 2.3 | Applicable | 0.292 | 0.012 | 0.105 | 5.57 | 0.45 | Inventive Example |
| 9 | Electron Beam | A | 250 | 2.9 | Not Applicable | 0.305 | −0.004 | 0.095 | 5.67 | 0.28 | Comparative Example |
| 10 | Electron Beam | A | 195 | 3.1 | Applicable | 0.278 | 0.006 | 0.085 | 5.54 | 0.28 | Inventive Example |
| 11 | Electron Beam | A | 220 | 4.2 | Not Applicable | 0.294 | −0.015 | 0.086 | 6.17 | −0.17 | Comparative Example |
| 12 | Electron Beam | A | 210 | 3.8 | Applicable | 0.268 | 0.003 | 0.075 | 5.48 | 0.25 | Inventive Example |
| 13 | Electron Beam | A | 200 | 5.0 | Not Applicable | 0.278 | −0.021 | 0.114 | 6.36 | −0.46 | Comparative Example |
| 14 | Electron Beam | A | 190 | 4.8 | Not Applicable | 0.276 | −0.014 | 0.116 | 6.12 | −0.29 | Comparative Example |
| 15 | Laser | A | 150 | 4.9 | Applicable | 0.246 | 0.004 | 0.062 | 5.40 | 0.21 | Inventive Example |
| 16 | Laser | C | 170 | 2.1 | Applicable | 0.255 | 0.010 | 0.062 | 5.62 | 0.50 | Inventive Example |
| 17 | Laser | A | 150 | 1.2 | Not Applicable | 0.251 | −0.001 | 0.043 | 5.56 | 0.15 | Comparative Example |
| 18 | Laser | A | 105 | 3.7 | Not Applicable | 0.267 | 0.000 | 0.053 | 5.68 | 0.16 | Comparative Example |
| 19 | Laser | A | 120 | 4.7 | Applicable | 0.262 | 0.004 | 0.066 | 5.48 | 0.21 | Inventive Example |
| 20 | Laser | A | 85 | 3.4 | Not Applicable | 0.273 | 0.001 | 0.041 | 5.72 | 0.20 | Comparative Example |
| 21 | Electron Beam | A | 265 | 1.8 | Applicable | 0.285 | 0.013 | 0.132 | 5.30 | 0.65 | Inventive Example |
| 22 | Electron Beam | A | 255 | 2.2 | Applicable | 0.287 | 0.012 | 0.138 | 5.23 | 0.69 | Inventive Example |

*A: over 10 MPa to 15 MPa or less, B: over 5 MPa to 10 MPa or less, C: 5 MPa or less It can be seen from Table 1 that the eddy current loss was reduced and the magnetic domains were subdivided in any of the cases shown, but the hysteresis loss improved only in those cases where Expression (1) is satisfied. It is also understood that the coercive force Hc was also reduced in the latter cases, allowing for excitation with a small external magnetic field.

It was further found that the improvement in hysteresis loss $\Delta Wh_{17/50}$ and the improvement in coercive force ΔHc tend to be more pronounced with a lower coating tension. Presumably, the reason is that as the coating tension increases, fewer lancet domains are present before electron beam irradiation or laser irradiation, and consequently, a higher coating tension results in less significant improvement achieved by irradiation.

Example 2

Electron beam irradiation was performed under the same conditions as described in Example 1, except that grain oriented electrical steel sheets having measured sheet thicknesses of 0.18 mm, 0.19 mm, and 0.24 mm were used.

The measurement results thereof are shown in Table 2.

TABLE 2

| No. | Resion X Applied by | Sheet Thickness (mm) | Coating Tension* | w (μm) | s (counts) | Conditional Expression Applicability | Hysteresis Loss $Wh_{17/50}$ (W/kg) | Improvement in Hysteresis Loss $\Delta Wh_{17/50}$ (W/kg) | Improvement in Eddy Current Loss $\Delta We_{17/50}$ (W/kg) | Coersive Force Hc (A/m) | Improvement in Coersive Force ΔHc (A/m) | Remarks |
|---|---|---|---|---|---|---|---|---|---|---|---|---|
| 23 | Electron Beam | 0.18 | A | 280 | 2.5 | Applicable | 0.304 | 0.018 | 0.207 | 6.02 | 0.77 | Inventive Example |
| 24 | Electron Beam | 0.18 | A | 210 | 5.0 | Applicable | 0.295 | 0.010 | 0.222 | 6.21 | 0.61 | Inventive Example |
| 25 | Electron Beam | 0.19 | A | 345 | 5.0 | Not Applicable | 0.298 | 0.002 | 0.263 | 6.12 | 0.32 | Comparative Example |
| 26 | Electron Beam | 0.19 | A | 260 | 1.3 | Applicable | 0.280 | 0.012 | 0.136 | 5.59 | 0.66 | Inventive Example |
| 27 | Electron Beam | 0.19 | A | 260 | 2.5 | Applicable | 0.286 | 0.013 | 0.201 | 5.89 | 0.39 | Inventive Example |
| 28 | Electron Beam | 0.19 | A | 220 | 4.0 | Applicable | 0.284 | 0.007 | 0.194 | 6.12 | 0.11 | Inventive Example |
| 29 | Electron Beam | 0.24 | A | 270 | 1.4 | Applicable | 0.286 | 0.004 | 0.120 | 5.22 | 0.04 | Inventive Example |
| 30 | Electron Beam | 0.24 | A | 270 | 2.2 | Not Applicable | 0.273 | −0.012 | 0.142 | 5.27 | −0.13 | Comparative Example |
| 31 | Electron Beam | 0.24 | A | 270 | 3.3 | Not Applicable | 0.272 | −0.018 | 0.162 | 5.40 | −0.18 | Comparative Example |
| 32 | Electron Beam | 0.24 | A | 210 | 5.0 | Not Applicable | 0.268 | −0.028 | 0.174 | 5.42 | −0.23 | Comparative Example |

*A: over 10 MPa to 15 MPa or less, B: over 5 MPa to 10 MPa or less, C: 5 MPa or less It can be seen from Table 2 that those steel sheets having a sheet thickness other than 0.22 mm and satisfying Expression (2) also exhibited improvements in hysteresis loss and coercive force, resulting in low hysteresis loss and low coercive force.

Example 3

Further, 100-mm wide steel sheets subjected to magnetic domain refining were used to produce model transformers, each being 500 mm square and simulating a transformer with an iron core of stacked three-phase tripod type, and the model transformers thus obtained were subjected to noise measurements.

The model transformers were formed from a stack of steel sheets that were sheared to have beveled edges, with a stack thickness of about 15 mm and an iron core weight of about 20 kg. The transformers were excited with the three phases being 120 degrees out of phase with one another, where noise was measured under excitation at 1.7 T, 50 Hz. A microphone was used to measure noise at (two) positions 20 cm away from the iron core surface, in which noise levels were represented in units of dBA with A-scale frequency weighting (JIS C 1509).

Table 3 shows the measurement results.

TABLE 3

| Steel Sheet No. | Transformer Noise (dBA) Before Irradiation | After Irradiation | Remarks |
|---|---|---|---|
| 13 | 36 | 38 | Comparative Example |
| 22 | 35 | 34 | Inventive Example |
| 27 | 34 | 33 | Inventive Example |

A steel sheet of No. 13, which is a comparative example, exhibited an increase in noise after being subjected to magnetic domain refining treatment. Presumably, the reason is that closure domains formed excessively in the steel sheet and magnetic strain increased accordingly.

In contrast, steel sheets of No. 22 and No. 27, which are inventive examples, exhibited a reduction in noise after being subjected to magnetic domain refining treatment. It is believed that while closure domains X applied by irradiation cause, similar to lancet domains, an increase in magnetic strain, increase in closure domains applied by irradiation is more than offset by reduction in lancet domains, resulting in an advantageous condition for reducing magnetic strain as a whole.

The invention claimed is:

1. A grain-oriented electrical steel sheet comprising closure domain regions X formed by electron beam irradiation to divide magnetic domains of the steel sheet in a rolling direction, from one end to the other in the width direction of the steel sheet, in a linear or curved manner, and periodically in the rolling direction, provided that Expression (1) is satisfied:

$$-(500t-80)\times s+230\leq w\leq-(500t-80)\times s+330 \quad \text{Expression (1)},$$

where t represents a sheet thickness in millimeters; w represents a smaller one of the widths in micrometers of the regions X measured on front and rear surfaces of the steel sheet, respectively, by using a Bitter method; and s represents an average number of the regions X present within one crystal grain, wherein s is about 0.3 to about 5.0, w is about 30 μm to about 320 μm, and t is 0.27 mm or less.

2. The grain-oriented electrical steel sheet according to claim 1, wherein a change of hysteresis loss is ≥0.003 W/kg.

3. The grain-oriented electrical steel sheet according to claim 1, wherein t is 0.18 mm to 0.27 mm.

4. The grain-oriented electrical steel sheet according to claim 1, wherein t is 0.18 mm to 0.24 mm.

5. The grain-oriented electrical steel sheet according to claim 1, wherein w is 120 μm to 295 μm and s is 1.0 to 5.0.

6. The grain-oriented electrical steel sheet according to claim 5, wherein t is 0.18 mm to 0.27 mm.

7. The grain-oriented electrical steel sheet according to claim 5, wherein t is 0.18 mm to 0.24 mm.

8. The grain-oriented electrical steel sheet according to claim 5, wherein w is 195 μm to 295 μm.

9. The grain-oriented electrical steel sheet according to claim 8, wherein t is 0.18 mm to 0.27 mm.

10. The grain-oriented electrical steel sheet according to claim 8, wherein t is 0.18 mm to 0.24 mm.

11. A grain-oriented electrical steel sheet comprising closure domain regions X formed by electron beam irradiation to divide magnetic domains of the steel sheet in a rolling direction, from one end to the other in the width direction of the steel sheet, in a linear or curved manner, and periodically in the rolling direction, provided that Expression (1) is satisfied:

$$-(500t-80)\times s+230\leq w\leq-(500t-80)\times s+330 \quad \text{Expression (1)},$$

where t represents a sheet thickness and is 0.27 mm or less; w represents a smaller one of the widths in micrometers of the regions X measured on front and rear surfaces of the steel sheet and is about 30 μm to about 320 μm, respectively, by using a Bitter method; and s represents an average number of the regions X present within one crystal grain and is about 0.3 to about 5.0, wherein a change of hysteresis loss is 0.003 W/kg.

12. The grain-oriented electrical steel sheet according to claim 11, wherein t is 0.18 mm to 0.27 mm.

13. The grain-oriented electrical steel sheet according to claim 11, wherein t is 0.18 mm to 0.24 mm.

14. The grain-oriented electrical steel sheet according to claim 11, w is 120 μm to 295 μm and s is 1.0 to 5.0.

15. The grain-oriented electrical steel sheet according to claim 14, wherein w is 195 μm to 295 μm.

16. A method for producing the grain-oriented electrical steel sheet according to claim 1, the method comprising, in irradiating one surface of the steel sheet with an electron beam, adjusting, depending on an average grain size of the steel sheet, at least any one of a periodic irradiation interval L in the rolling direction, irradiation energy E, and a beam diameter a, so that closure domain regions X are formed to divide magnetic domains of the steel sheet in a rolling direction, from one end to the other in the width direction of the steel sheet, in a linear or curved manner, and periodically in the rolling direction, wherein the electron beam radiating repeated along a scanning line so that a long irradiation time and a short irradiation time alternate, and a dot pitch between repetitions of the irradiation is 0.05 mm to 0.6 mm, and an irradiation frequency is 10 kHz to 25 kHz.

* * * * *